US010507472B2

(12) United States Patent
Peltola et al.

(10) Patent No.: US 10,507,472 B2
(45) Date of Patent: Dec. 17, 2019

(54) METHOD FOR CONSTRUCTING A FLOTATION APPARATUS, FLOTATION APPARATUS, METHOD AND SYSTEM FOR FLOTATION AND USE

(71) Applicant: OUTOTEC (FINLAND) OY, Espoo (FI)

(72) Inventors: Aleksi Peltola, Espoo (FI); Rodrigo Grau, Pori (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 16/061,060

(22) PCT Filed: Dec. 15, 2016

(86) PCT No.: PCT/FI2016/050873
§ 371 (c)(1),
(2) Date: Jun. 11, 2018

(87) PCT Pub. No.: WO2017/103332
PCT Pub. Date: Jun. 22, 2017

(65) Prior Publication Data

US 2019/0126292 A1 May 2, 2019

(30) Foreign Application Priority Data

Dec. 18, 2015 (FI) ..... 20155965

(51) Int. Cl.
*B03D 1/16* (2006.01)
*B03D 1/04* (2006.01)
*B03D 1/22* (2006.01)

(52) U.S. Cl.
CPC ..... *B03D 1/16* (2013.01); *B03D 1/04* (2013.01); *B03D 1/22* (2013.01)

(58) Field of Classification Search
CPC ..... B03D 1/04; B03D 1/16; B03D 1/22
(Continued)

(56) References Cited

U.S. PATENT DOCUMENTS 2,134,410 A * 10/1938 Max ..... B03D 1/16 209/169
2,269,583 A * 1/1942 Dromgold ..... B03D 1/16 261/42

(Continued)

FOREIGN PATENT DOCUMENTS

DE 69831756 T2 9/2009
EP 0224762 A2 6/1987

(Continued)

OTHER PUBLICATIONS

Finnish Search Report issued by the Finnish Patent and Registration Office in relation to Finnish Application No. 20155965 dated Jun. 16, 2016 (1 page).

(Continued)

*Primary Examiner* — Terrell H Matthews
(74) *Attorney, Agent, or Firm* — Robert P. Michal, Esq.; Carter, DeLuca & Farrell, LLP

(57) ABSTRACT

The flotation apparatus includes a flotation vessel and a cover for closing an upwards open opening of the flotation vessel, wherein the cover and the flotation vessel limits a vessel space for receiving fluid, and an agitating means having a rotatable axis extending through a first aperture in the cover. The rotatable shaft is rotatable supported at a bearing housing outside the vessel space. A connection arrangement surrounds the rotatable shaft between the bearing housing and the cover.

15 Claims, 13 Drawing Sheets

(DET A FIG 3:)

(58) Field of Classification Search
USPC ..... 209/169
See application file for complete search history.

(56) References Cited

U.S. PATENT DOCUMENTS 2,375,282 A * 5/1945 Clemens ..... B01D 21/0018 210/109
2,713,477 A * 7/1955 Daman ..... B03D 1/16 261/87
3,599,990 A * 8/1971 Greiner ..... B63H 23/36 277/370
3,722,679 A * 3/1973 Logue ..... B01F 3/04446 209/164
4,028,229 A * 6/1977 Dell ..... B03D 1/22 209/164
5,188,377 A * 2/1993 Drumm ..... F16J 15/3488 277/353
5,281,033 A * 1/1994 Ide ..... B65G 39/09 384/213
2003/0030157 A1 * 2/2003 Petrescu ..... B01F 3/04765 261/92
2004/0130042 A1 7/2004 Blakley et al.

FOREIGN PATENT DOCUMENTS

WO WO-2013054610 A1 * 4/2013 ..... F16J 15/3488
WO WO-2013067343 A1 * 5/2013 ..... B03D 1/1412

OTHER PUBLICATIONS

International Search Report issued by the European Patent Office acting as the International Searching Authority in relation to International Patent Application No. PCT/FI2016/050873 dated Dec. 15, 2017 (6 pages).
Written Opinion of the International Searching Authority issued by the European Patent Office acting as the International Searching Authority in relation to International Patent Application No. PCT/FI2016/050873 dated Dec. 15, 2017 (10 pages).

* cited by examiner (DET A FIG 3:)

METHOD FOR CONSTRUCTING A FLOTATION APPARATUS, FLOTATION APPARATUS, METHOD AND SYSTEM FOR FLOTATION AND USE

CROSS-REFERENCE TO RELATED APPLICATIONS

This application is a national phase entry under 35 U.S.C. 371 of PCT International Application No. PCT/FI2016/050873 filed Dec. 15, 2016, which claims priority to Finnish Patent Application No. 20155965, filed Dec. 18, 2015, the disclosure of each of these applications is expressly incorporated herein by reference in their entirety.

FIELD OF THE INVENTION

The invention relates to method for constructing a flotation apparatus.

The invention also relates to a flotation apparatus.

Publication EP 0 224 762 A2 concerns a reaction cell.

OBJECTIVE OF THE INVENTION

An object of the invention is to provide a method for constructing a flotation apparatus and a flotation apparatus which provides for effective sealing and isolating of the content of a vessel space of the flotation apparatus from the atmosphere surrounding the flotation apparatus.

BRIEF DESCRIPTION OF THE DRAWINGS

In the following the invention will described in more detail by referring to the figures, of which

DETAILED DESCRIPTION

Figure 1:
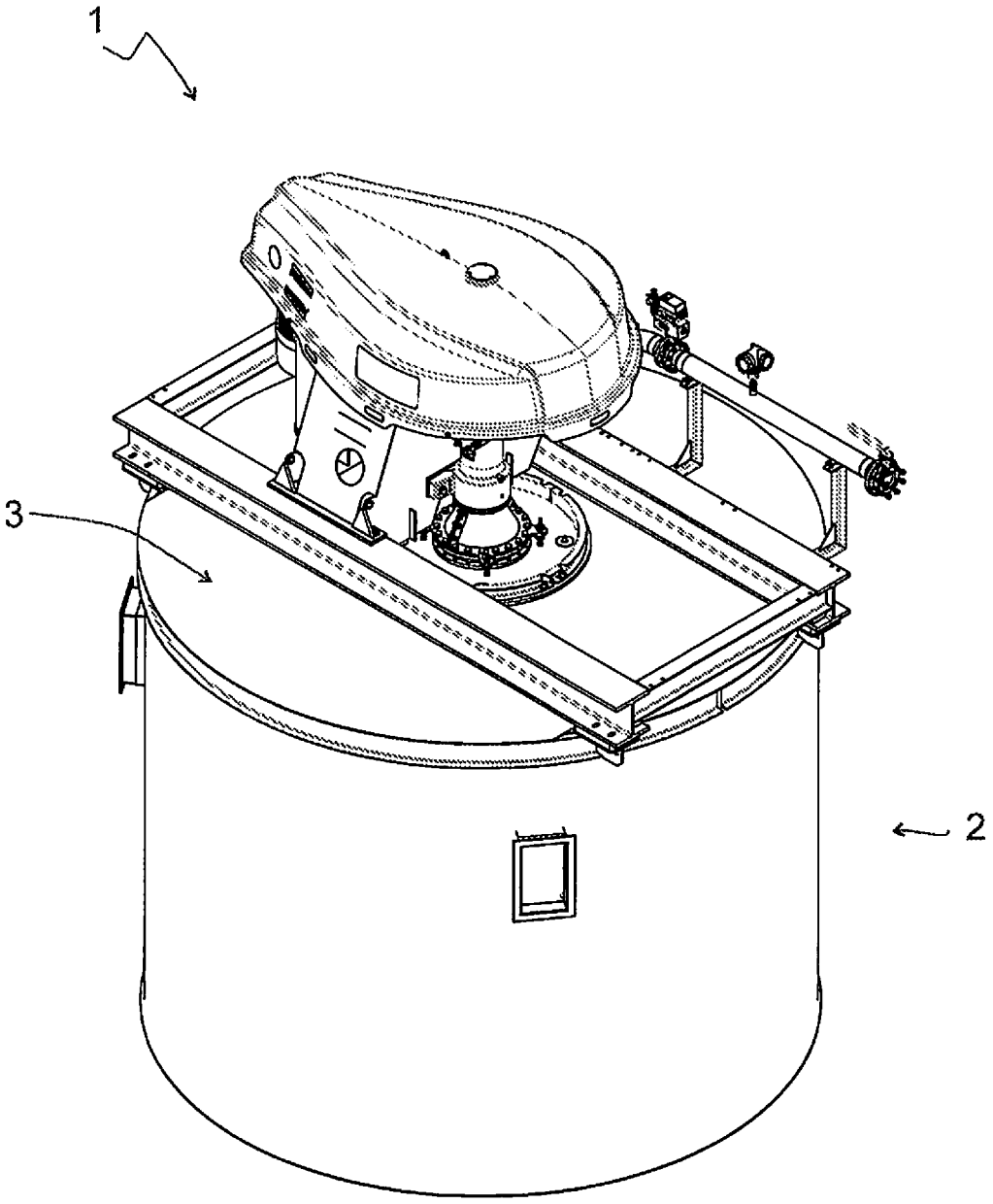
FIG. 1 shows a flotation apparatus.
Figure 2:
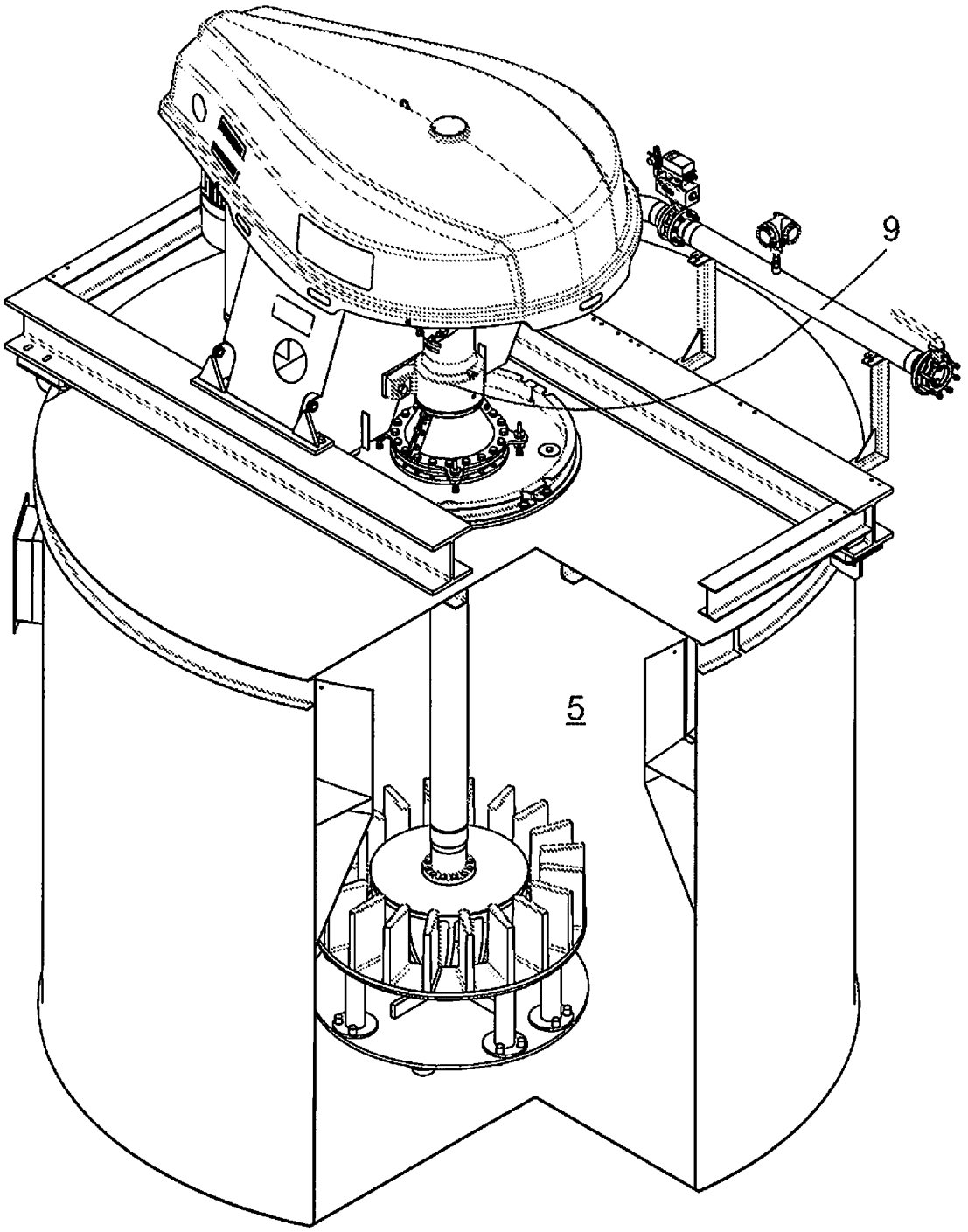
FIG. 2 shows the flotation apparatus shown in FIG. 1 in partly cut state.
Figure 3:
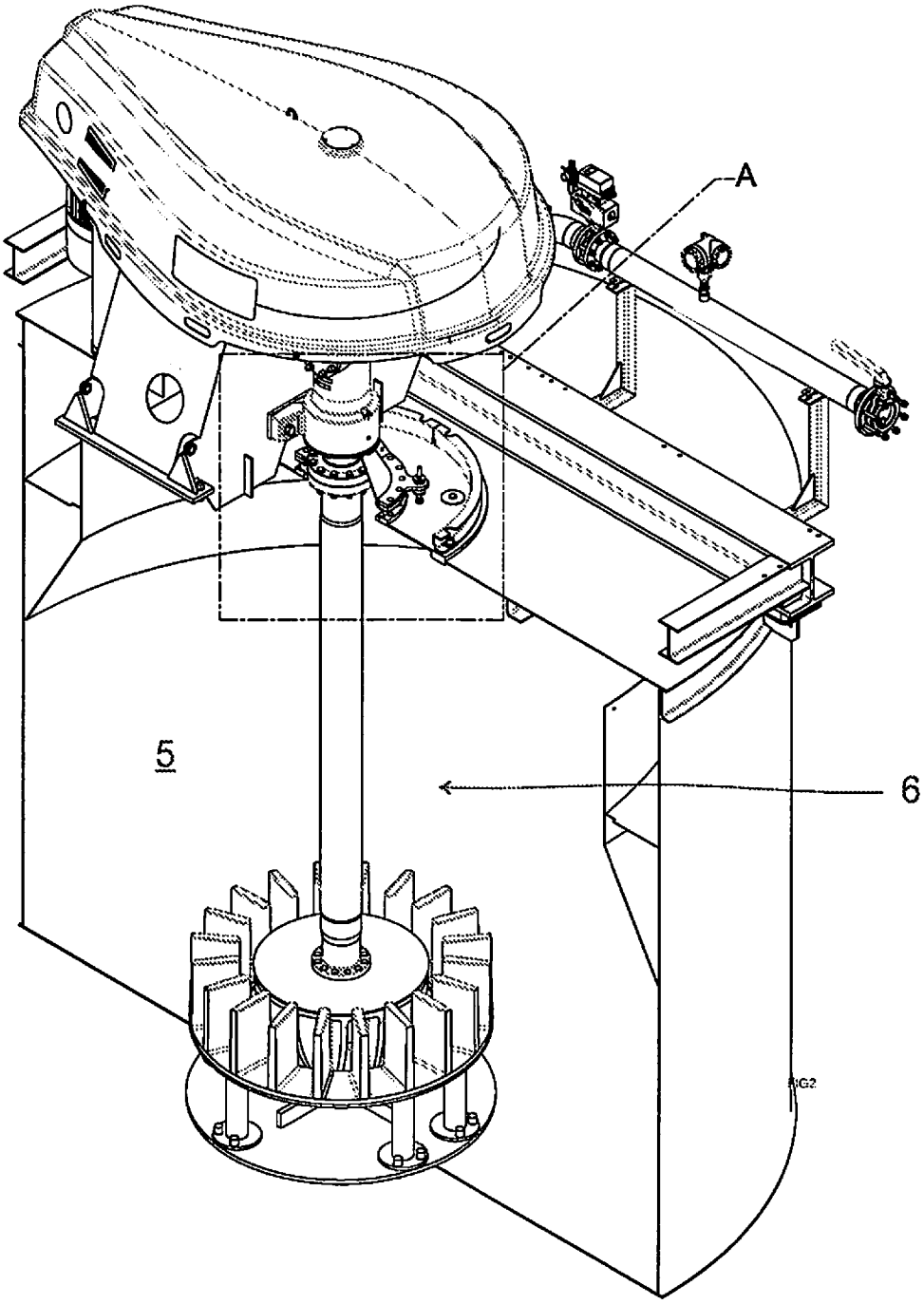
FIG. 3 shows the flotation apparatus shown in FIG. 1 in partly cut state.
Figure 4:
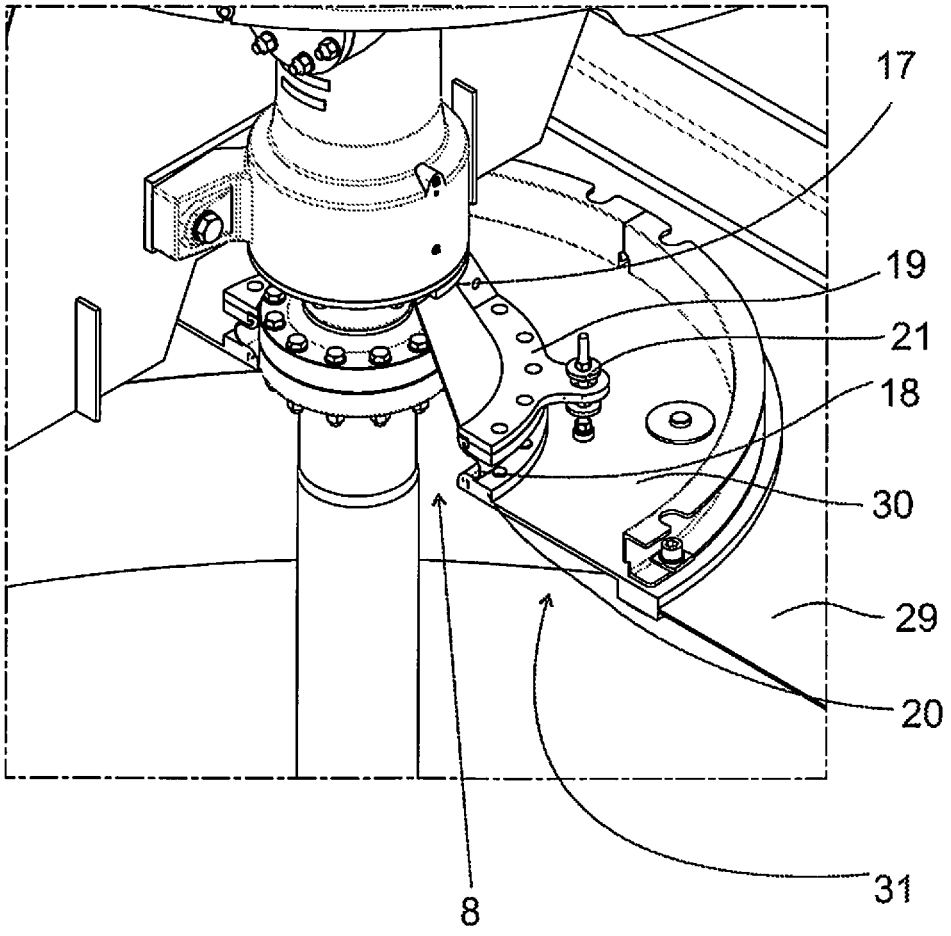
FIG. 4 shows detail A of FIG. 3 in greater scale.
Figure 5:
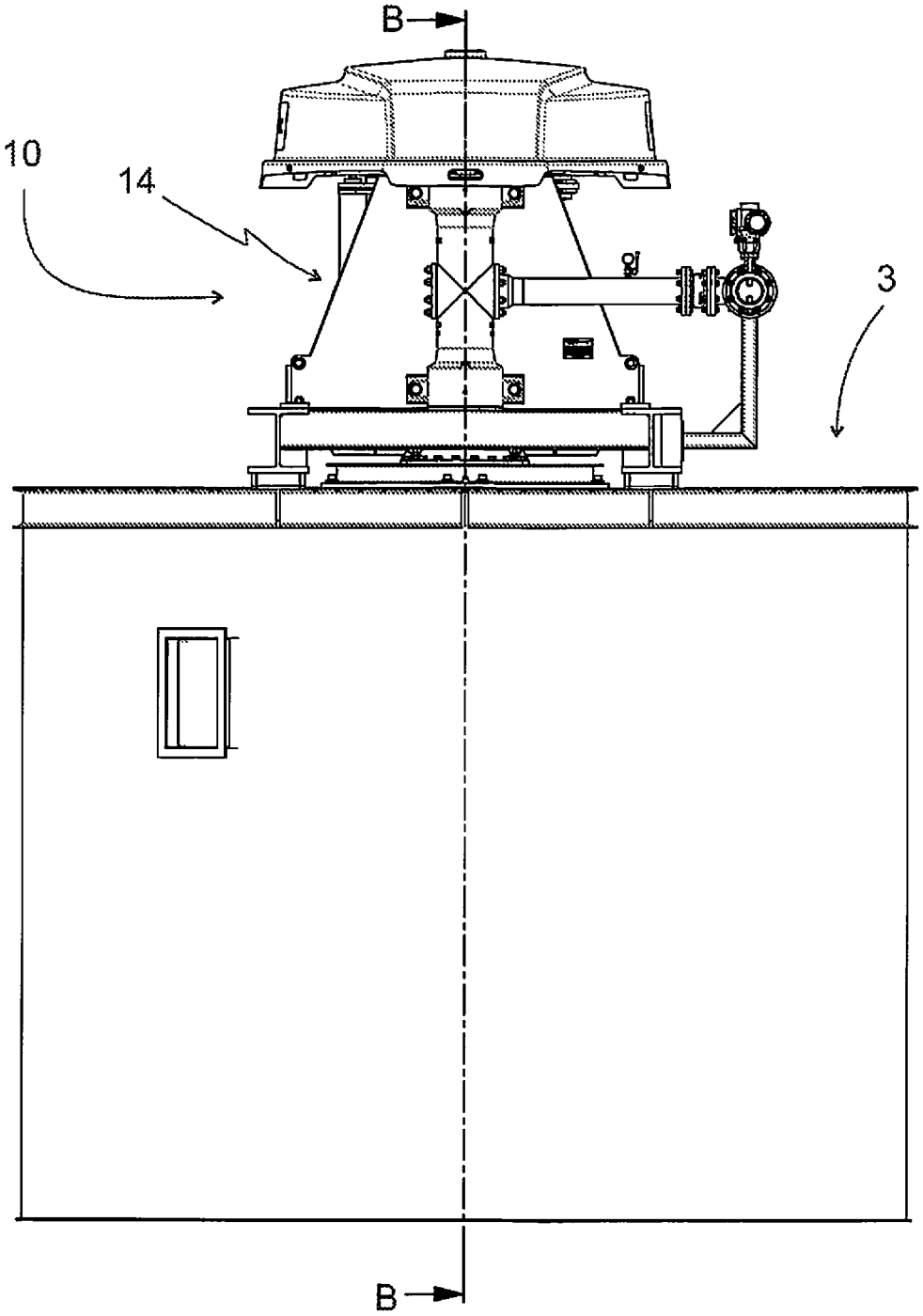
FIG. 5 shows the flotation apparatus shown in FIG. 1 from one side.
Figure 6:
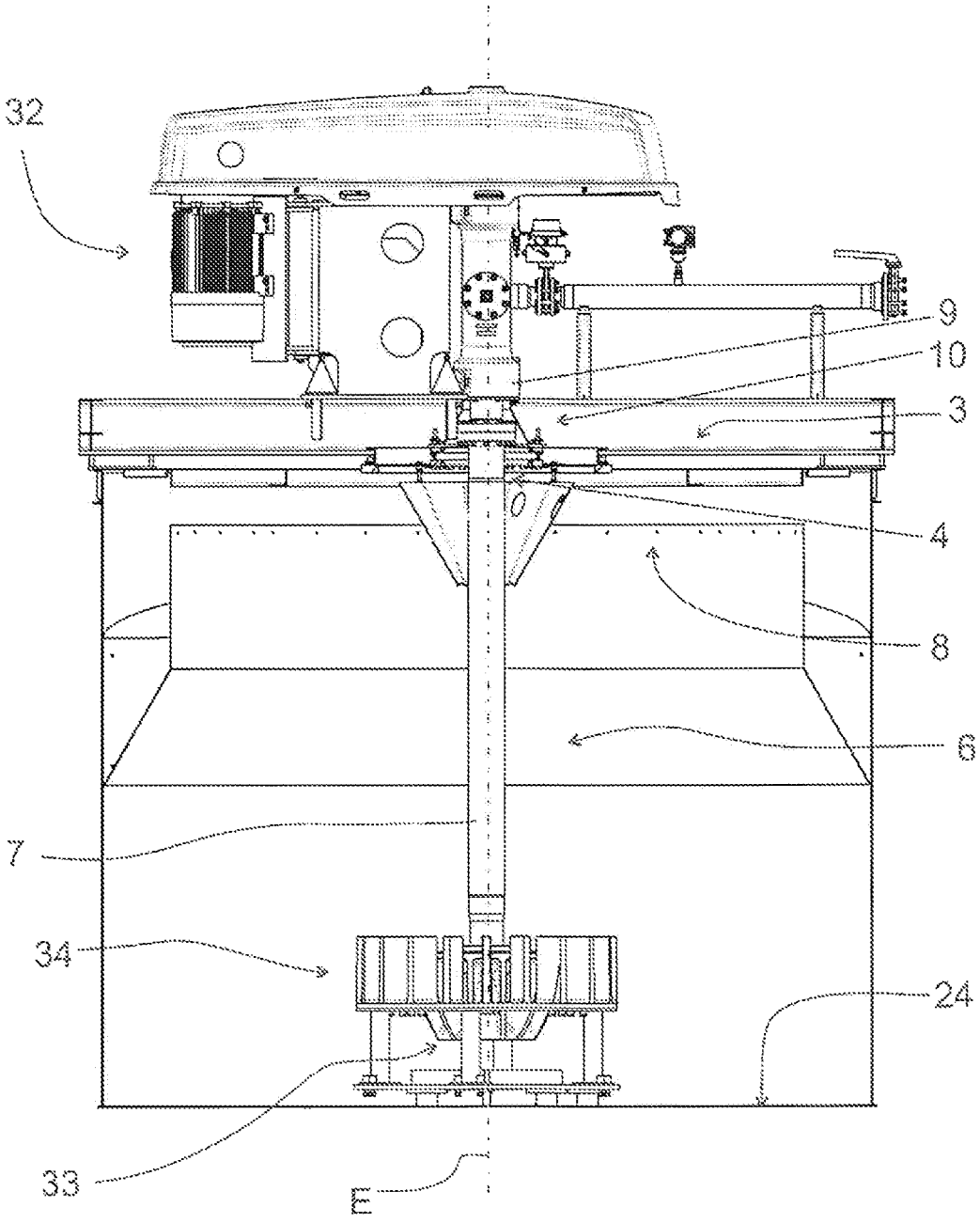
FIG. 6 shows the flotation apparatus shown in FIG. 1 as cut along line B-B in FIG. 5.
Figure 7:
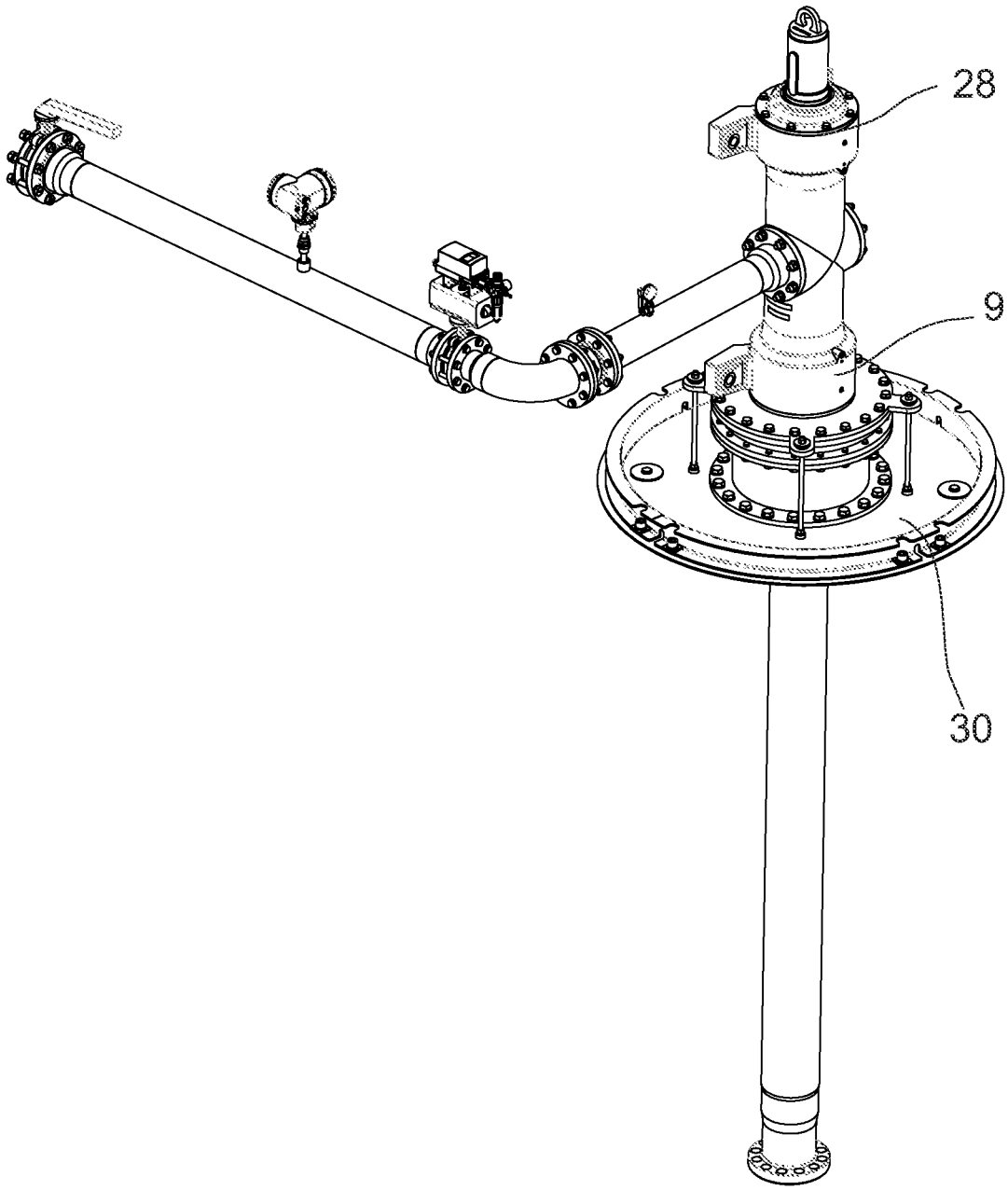
FIG. 7 shows an agitating means, which can be used in the flotation apparatus shown in FIG. 1.
Figure 8:
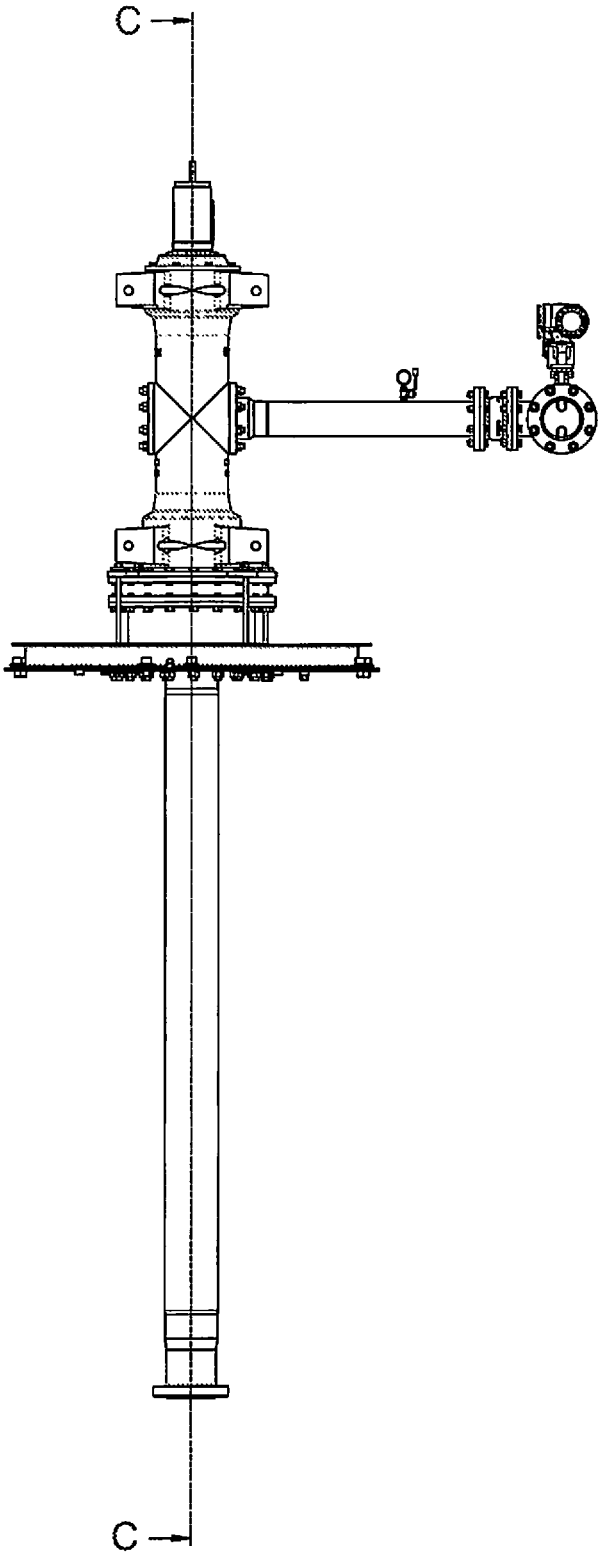
FIG. 8 shows the agitating means shown in FIG. 7 as seen from one side.
Figure 9:
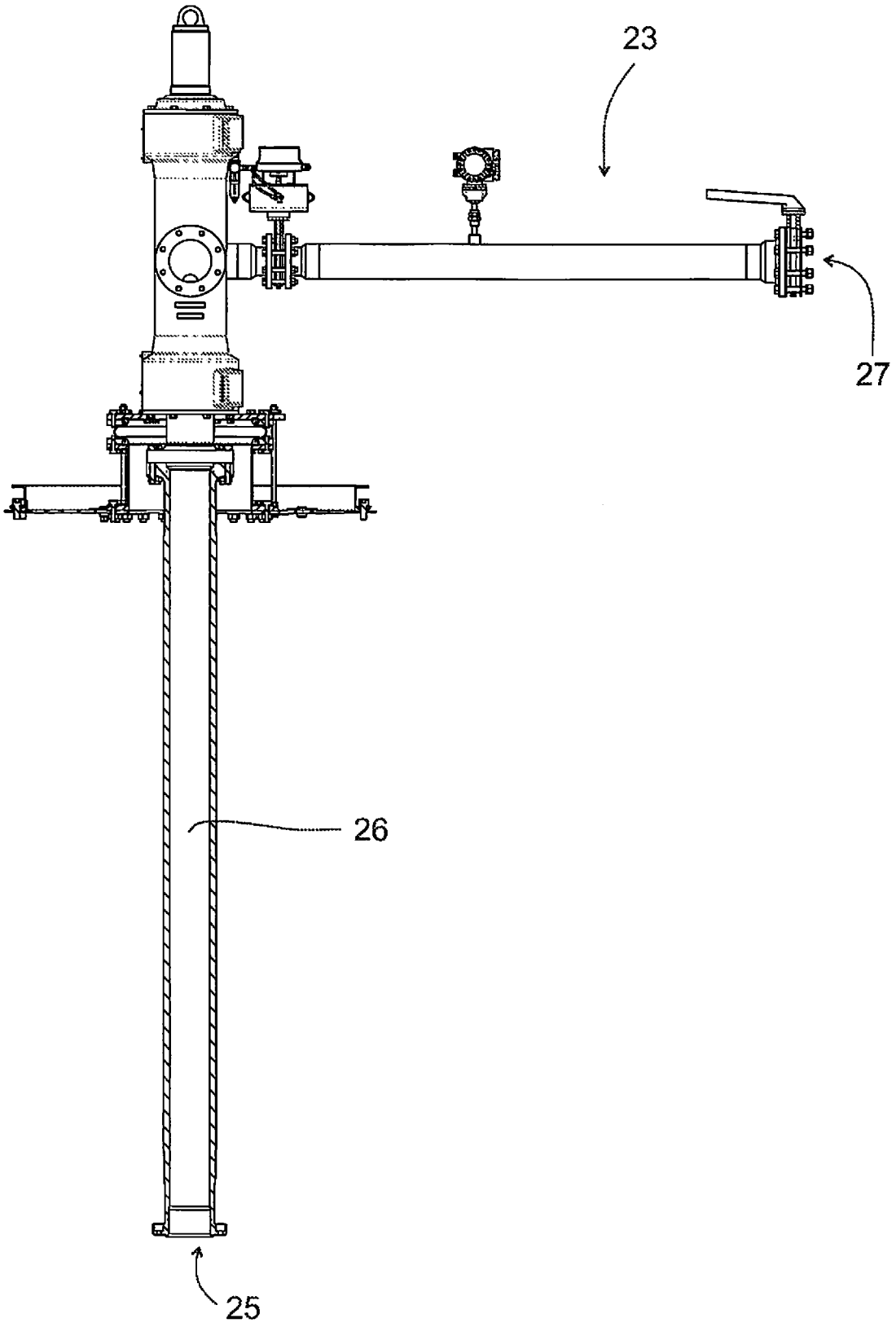
FIG. 9 shows the agitating means shown in FIG. 7 as partly cut along line C-C in FIG. 8.
Figure 10:
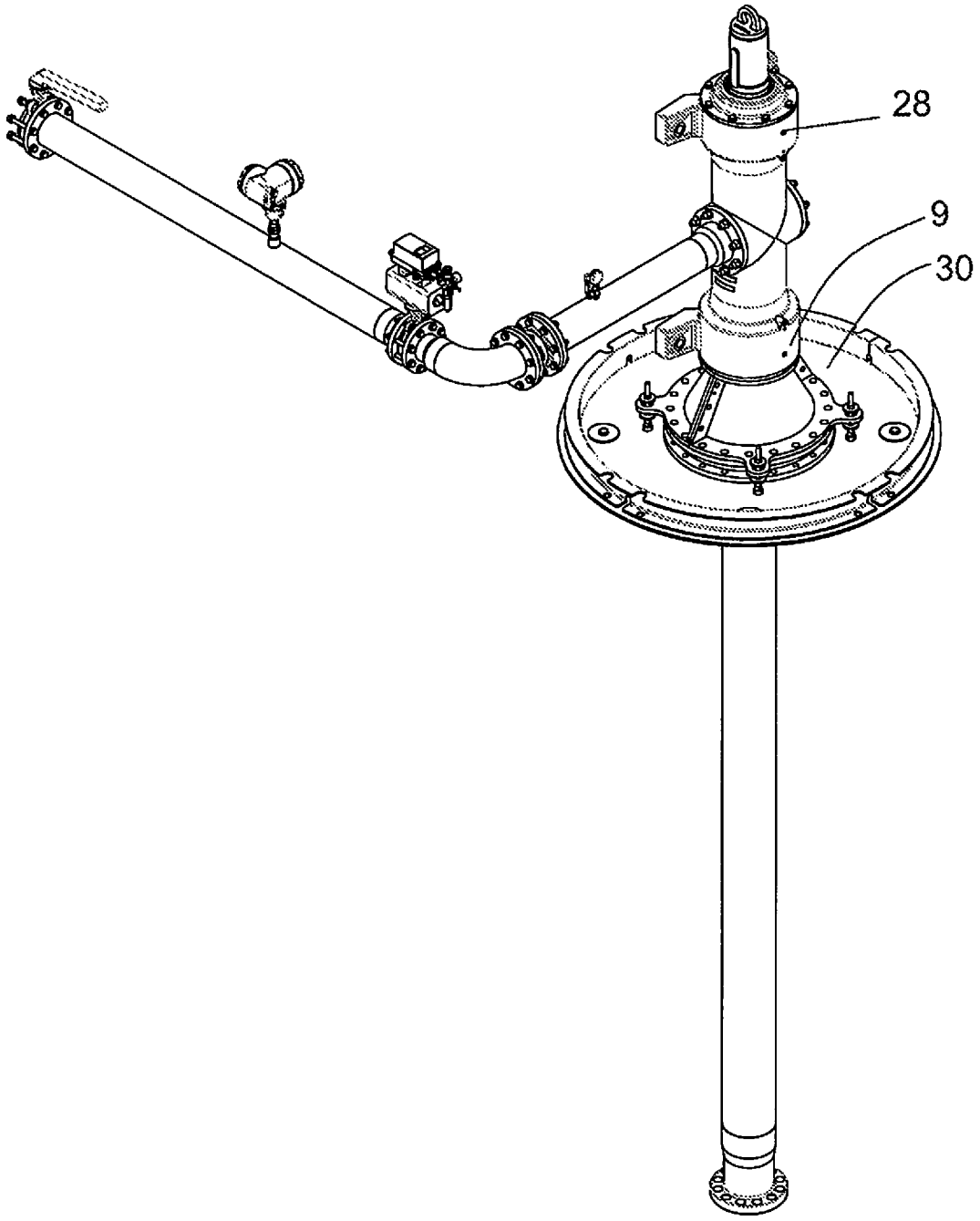
FIG. 10 shows the agitating means of the flotation apparatus shown in FIG. 1.
Figure 11:
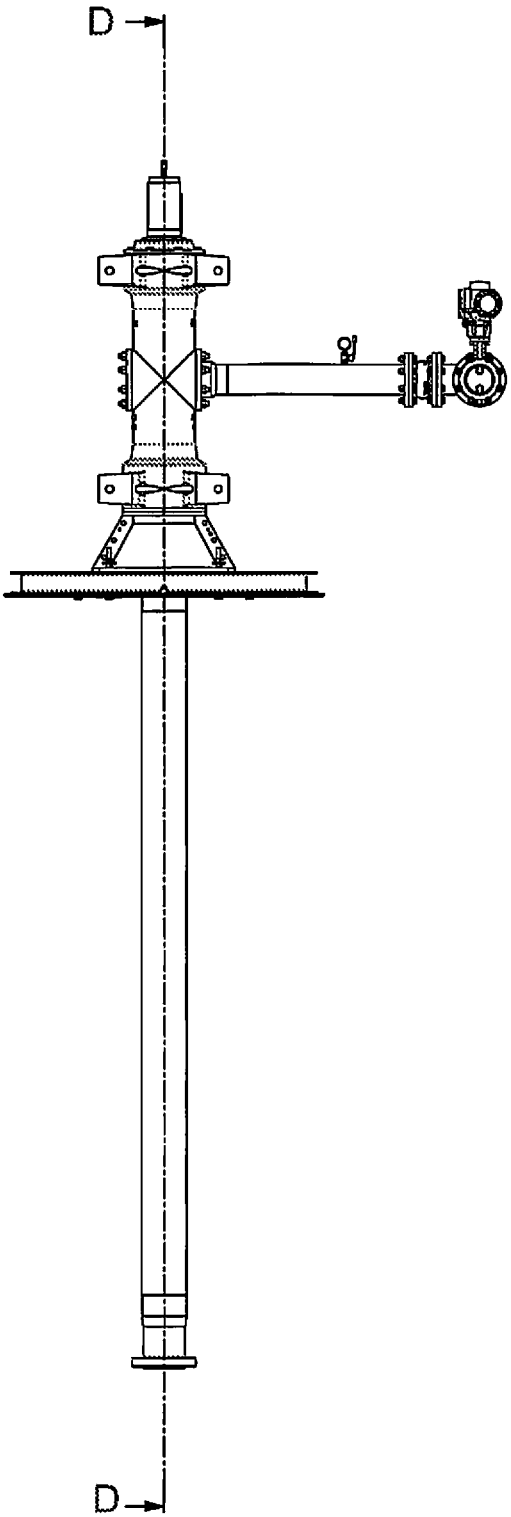
FIG. 11 shows the agitating means shown in FIG. 10 as seen from one side.
Figure 12:
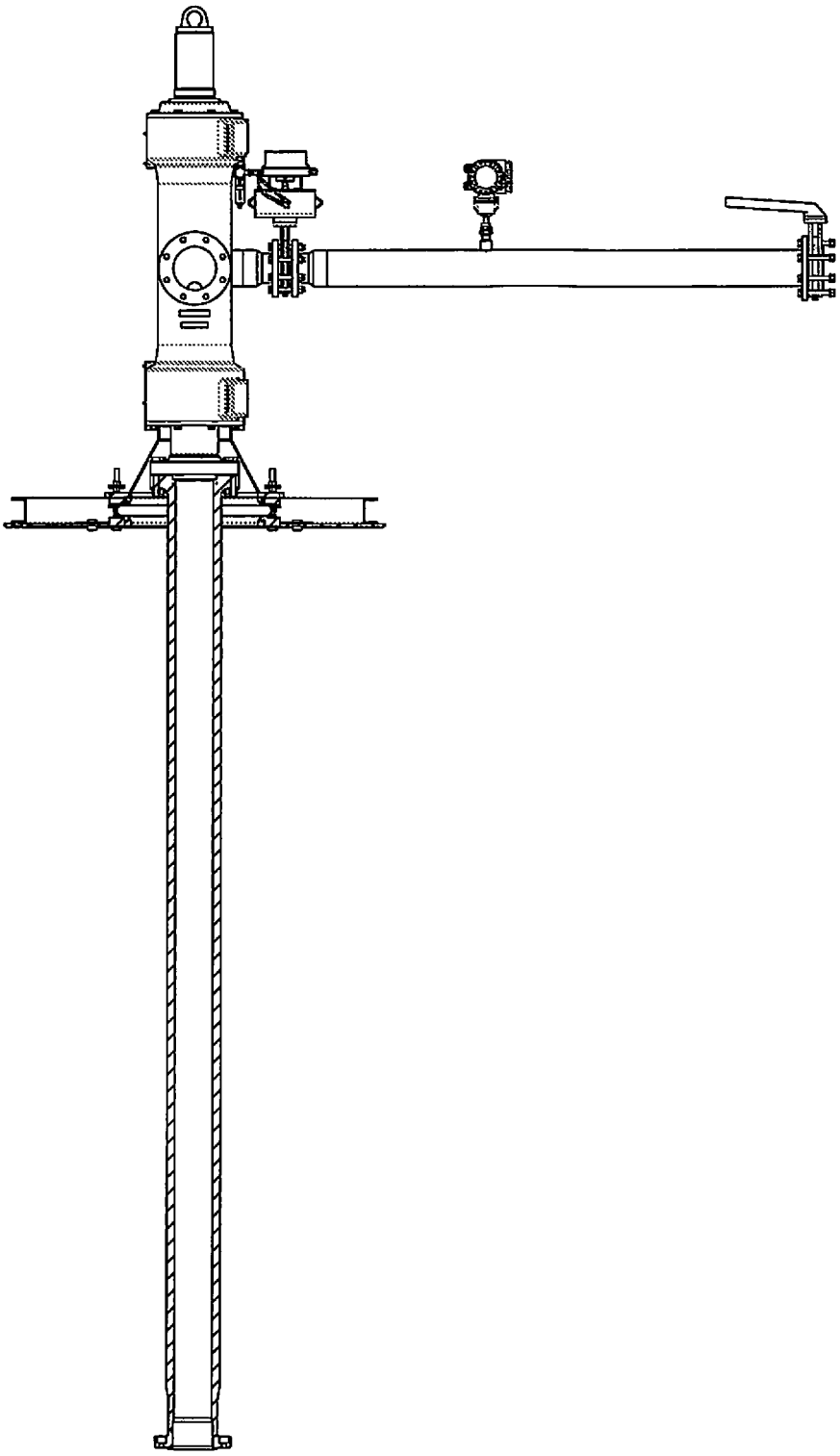
FIG. 12 shows the agitating means shown in FIG. 10 as partly cut along line D-D in FIG. 11.

First the method for constructing a flotation apparatus 1, such as a froth flotation apparatus, and some embodiments and variants of the method will be described in greater detail.

The method comprises providing a flotation vessel 2 and a cover 3 for closing an upwards open opening 4 of the flotation vessel 3, wherein the cover 3 and the flotation vessel 2 limiting a vessel space 5 for receiving fluid (not shown in the figures).

The method comprises providing an agitating means 6 having a rotatable shaft 7.

The method comprises arranging the rotatable shaft 7 of the agitating means 6 to extend through a first aperture 8 in the cover 3.

The method comprises supporting the rotatable shaft 7 at a bearing housing 9 outside the vessel space 5.

The method comprises providing a connection arrangement 10 that surrounds the rotatable shaft 7 between the bearing housing 9 and the cover 3.

A purpose of the connection arrangement 10 is to at least partly seal the rotatable shaft 7 from the surrounding environment between the bearing housing 9 and the cover 3.

The method may comprise by attaching the connection arrangement 10 to the bearing housing 9 to simplify the construction.

The method may comprise attaching the connection arrangement 10 to the cover 3 to simplify the construction.

The method may comprise attaching the connection arrangement 10 both to the bearing housing 9 and to the cover 3 so that the connection arrangement 10 hermetically sealing the rotatable shaft 7 between the bearing housing 9 and the cover 3 to simplify the construction.

The method may comprise providing a connection arrangement 10 comprising a connection piece 11 surrounding the rotatable shaft 7 between the bearing housing 9 and the cover 3.

The connection piece 11 that is provided may comprise at an end facing the bearing housing 9 a first opening 12 for the rotatable shaft 7, and at an end facing the vessel space 5 of the vessel space 5 a second opening 13 for the rotatable shaft 7.

The connection piece 11 that may be provided may comprise a hollow truncated cone 14 surrounding the rotatable shaft 7 between the bearing housing 9 and the cover 3 the connection piece 11, so that the hollow truncated cone 14 tapers towards the bearing housing 9, so that the connection piece 11 having at the end facing the bearing housing 9 the first opening 12 for the rotatable shaft 7, and so that the connection piece 11 having at the end facing the vessel space 5 of the flotation vessel 1 the second opening 13 for the rotatable shaft 7.

Figure 13:
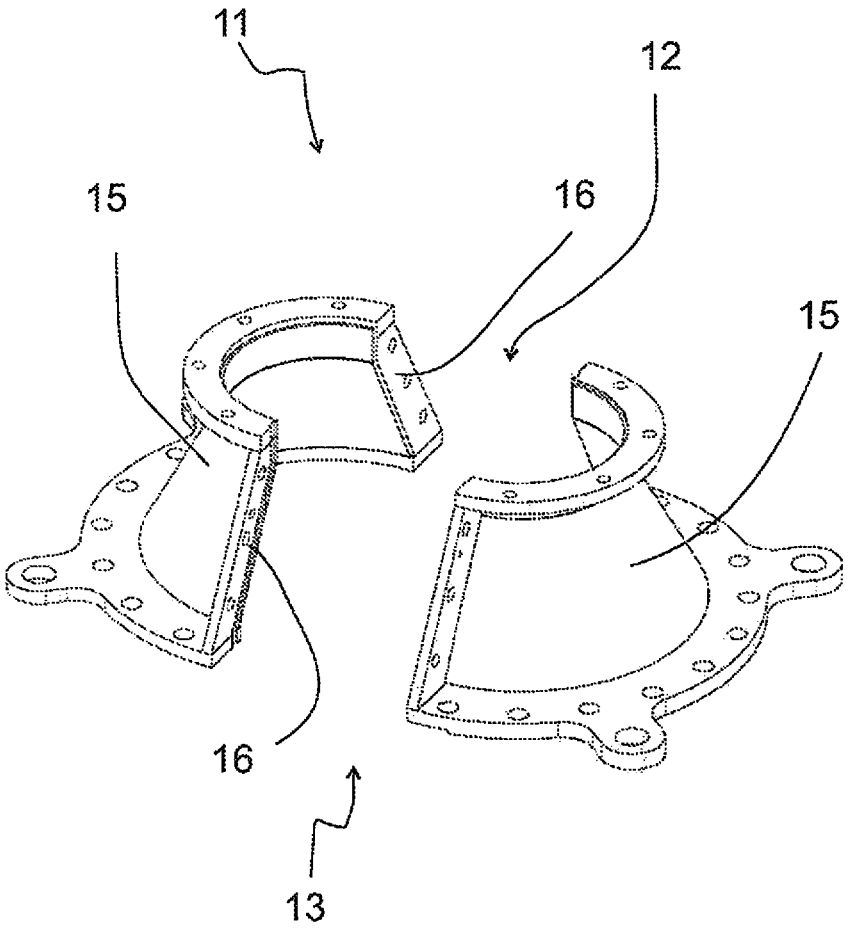
FIG. 13 shows the connecting piece of the flotation apparatus shown in FIG. 1 in exploded view.

The connection piece 11 that may be provided may, as shown in FIG. 13, comprise at least two connection piece parts 15 releasable connected to each other so that division planes 16 between said least two connection piece parts 15 extending between the first opening 12 and the second opening 13 so that the connection piece 11 can be removed from the surrounding state without moving the connection piece 11 via an end of the rotatable shaft 7.

The connection piece 11 that may be provided can comprise a first flange 17 at the end facing the bearing housing 9, wherein the method comprises releasable fastening the connection piece 11 to the bearing housing 9 by using the first flange 17. This facilitates removal and mounting of the connection piece 11.

The connection arrangement 10 that is provided may comprise a bellow arrangement 18 surrounding the rotatable shaft 7 between the bearing housing 9 and the cover 3 to provide for relative movement between the bearing housing 9 and the cover 3. The connection arrangement 10 may be composed of a bellow arrangement 18.

If a connection piece 11 of any of the embodiments as described earlier is provided, the possible bellow arrangement 18 can be arranged between the cover 3 and the connection piece 11, and the connection piece 11 is correspondingly between the bearing housing 9 and the bellow arrangement 18.

In the method, the optional bellow arrangement 18 can be attached to the connection piece 11 by means of a second flange 19, and the bellow arrangement 18 can be attached to the cover 3 by means of a third flange 20 to provide for tight, hermetically sealing. The second flange 19 can be connected with the third flange 20 by means of a travel limiter 21 to limit the travel of the second flange 19 with respect to the third flange 20, i.e. to prevent excess movement between the second flange 19 and the third flange 20.

The method may comprise providing a gasket (not shown in the figures) to surround the rotatable shaft 7 between the bearing housing 9 and the rotatable shaft 7 to provide for additional sealing, prevents possible toxic gases from escaping.

The method may comprise connecting a gas feeding means 23 in fluid connection with the vessel space 5. Gas from a gas feeding means 23 is normally needed in a flotation process. It is possible that the flotation vessel 2 that is provided comprises a vessel space 5 comprising an inner bottom 24, and in such case the method comprises preferably, but not necessarily, connecting the gas feeding means 23 in fluid connection with the vessel space 5 at a gas outlet 25 that is located closer to the inner bottom 24 of the vessel space 5 than to the upwards open opening 4 of the vessel space 5. Alternatively or additionally, it is possible to provide a gas feeding means 23 comprising a gas feeding duct 26 in the rotatable shaft 7 of the agitating means 6, outside the vessel space 5 a gas inlet 27 for feeding gas into the gas feeding duct 26, and inside the vessel space 5 a gas outlet 25 for feeding gas from the gas feeding duct 26 into the vessel space 5. In such case, the bearing housing 9 may being arranged between the gas inlet 27 and the cover 3 to enable proper sealing of the rotatable shaft 7 between the cover 3 and the bearing housing 9. In such case the method may comprise supporting the rotatable shaft 7 additionally at an additional bearing housing 28 so that the gas inlet 27 is situated between the bearing housing 9 and the additional bearing housing 28 to provide for stable supporting of the rotatable shaft 7 especially if rotatable shaft 7 is supported only outside the vessel space 5.

The vessel space 5 of the flotation vessel 2 that is provided may be a vertical cylindrical vessel space 5 having a circular inner bottom 24, and having an upwards open opening 4 in the form of a circular upwards open opening. In such case, the rotatable shaft 7 can be arranged to extend vertically at a vertical center axis E of the vertical cylindrical vessel space 5.

The agitating means 6 that is provided may comprise a rotor 33 that is attached to the rotatable shaft 7, preferably to a distal end of the rotatable shaft 7. The rotor 33 may be at least partly surrounded by a stator 34. The method may comprise fastening the stator 34 being fastened to the flotation vessel 2 in the vessel space 5, preferably to the circular inner bottom 24 of the vertical cylindrical inner space.

The method may comprise providing a flotation vessel 2, where the cover 3 is composed of a first cover part 29 and a second cover part 30 that is releasable attached to the first cover part 29, so that the first cover part 29 comprises a second aperture 31 that is covered by the second cover part 30, and so that the first aperture 8 is in the second cover part 30. In such case the method comprises fastening the connection arrangement 10 to the second cover part 30. In such case the method comprises providing the second aperture 31 so that it is circular and having a diameter that is larger than an outer diameter of a rotor 33 attached to the rotatable shaft 7. In such case the method comprises providing a sealing (not shown in the figures) between the first cover part 29 and the second cover part 30.

The method may comprise providing the agitating means 6 with a motor means 32 for rotating the rotatable shaft 7.

Next the flotation apparatus 1 such as a froth flotation apparatus and some embodiments and variants thereof will be described in greater detail.

The flotation apparatus 1 comprises a flotation vessel 2 and a cover 3 for closing an upwards open opening 4 of the flotation vessel. The cover 3 and the flotation vessel 2 limits a vessel space 5 for receiving fluid.

The flotation apparatus 1 comprises an agitating means 6 having a rotatable axis extending through a first aperture 8 in the cover 3.

The rotatable shaft 7 is rotatable supported at a bearing housing 9 outside the vessel space 5.

The flotation apparatus 1 comprises a connection arrangement 10 surrounding the rotatable shaft 7 between the bearing housing 9 and the cover 3. A purpose of the sealing arrangement is to at least partly seal the rotatable shaft 7 from the surrounding environment between the bearing housing 9 and the cover 3.

The connection arrangement 10 may be attached to the bearing housing 9, which results in a simplified construction.

The connection arrangement 10 may be attached to the cover 3, which results in a simplified construction.

The connection arrangement 10 may be attached to the bearing housing 9 and to the cover 3 so that the connection arrangement 10 hermetically sealing the rotatable shaft 7, which results in a simplified construction.

The connection arrangement 10 may comprise a connection piece 11 surrounding the rotatable shaft 7 between the bearing housing 9 and the cover 3. The connection piece 11 has preferably at the end facing the bearing housing 9 a first opening 12 for the rotatable shaft 7, and at the end facing the vessel space 5 of the flotation vessel 2 a second opening 13 for the rotatable shaft 7. In such case, the connection piece 11 comprises preferably, but not necessarily, a hollow truncated cone 14 so that the connection piece 11 tapers towards the bearing housing 9, so that the connection piece 11 having at the end facing the bearing housing 9 the first opening 12 for the rotatable shaft 7, and so that the connection piece 11 having at the end facing the vessel space 5 of the flotation vessel 2 the second opening 13 for the rotatable shaft 7.

If the connection arrangement 10 comprises a connection piece 11 as described earlier having at the end facing the bearing housing 9 a first opening 12 for the rotatable shaft 7, and having at the end facing the vessel space 5 of the flotation vessel 2 a second opening 13 for the rotatable shaft 7, as described, the connection piece 11 comprises preferably, but not necessarily, at least two connection piece parts 15 releasable connected to each other, so that division planes 16 between said least two connection piece parts 15 extending between the first opening 12 and the second opening 13. This provides for removing and mounting of the connection piece 11 from the surrounding state without moving the connection piece 11 via an end of the rotatable shaft 7.

If the connection arrangement 10 comprises a connection piece 11 as described earlier, the connection piece 11 may comprise a first flange 17 at the end facing the bearing housing 9 for releasable fastening the connection piece 11 to the bearing housing 9 to facilitate removal and mounting of the connection piece 11

The connection arrangement 10 may comprise a bellow arrangement 18 surrounding the rotatable shaft 7 between the bearing housing 9 and the cover 3 to provide for relative movement between the bearing housing 9 and the cover 3. The bellow arrangement 18 may substitute a connection piece 11.

If the connection arrangement 10 comprise a bellow arrangement 18 surrounding the rotatable shaft 7 between the bearing housing 9 and the cover 3, the bellow arrangement 18 may be arranged between the cover 3 and the connection piece 11, and the connection piece 11 may be arranged between the bearing housing 9 and the bellow arrangement 18 as in the embodiments shown in the figures. If the connection arrangement 10 comprises both a bellow arrangement 18 and a connection piece 11, the bellow arrangement 18 can be made small. In the embodiment shown in the figures, the bellow arrangement 18 is attached to the connection piece 11 by means of a second flange 19, and the bellow arrangement 18 is attached to the cover 3 by means of a third flange 20. In the embodiment shown in the figures, the second flange 19 is connected with the third flange 20 by means of a travel limiter 21 configured to limit the travel of the second flange 19 with respect to the third flange 20 to prevent excess movement of the of the second flange 19 with respect to the third flange 20. The flotation apparatus 1 may comprise a gasket (not shown in the figures) surrounding the rotatable shaft 7 between the bearing housing 9 and the rotatable shaft 7 to provide for additional sealing and to prevent possible toxic gases from escaping from between the bearing housing 9 and the rotatable shaft 7.

The flotation apparatus 1 may comprise gas feeding means 23 for feeding gas needed for the flotation process into the vessel space 5. If the vessel space 5 comprising an inner bottom 24, the gas feeding means 23 may be configured to feed gas into the vessel space 5 at a gas outlet 25 that is located closer to the inner bottom 24 of the vessel space 5 than to the cover 3. Alternatively or additionally the gas feeding means 23 may comprise a gas feeding duct 26 in the rotatable shaft 7 of the agitating means 6, outside the vessel space 5 a gas inlet 27 for feeding gas into the gas feeding duct 26, and inside the vessel space 5 a gas outlet 25 for feeding gas from the gas feeding duct 26 into the vessel space 5. In such case the bearing housing 9 may be arranged between the gas inlet 27 and the cover 3 to provide for proper sealing of the rotatable shaft 7 between the cover 3 and the bearing housing 9.

The vessel space 5 of the flotation apparatus 1 may, as shown in the figures, be a vertical cylindrical vessel space 5 having a circular inner bottom 24, and having a circular open top. In such case, the rotatable shaft 7 may extend vertically at a vertical center axis E of the vertical cylindrical vessel space 5, as shown in the figures.

The agitating means 6 of the flotation apparatus 1 may, as shown in the figures, comprise a rotor 33 that is attached to the rotatable shaft 7. In such case the rotor 33 may be at least partly surrounded by a stator 34. The stator 34 may be fastened to the flotation vessel 2 in the vessel space 5.

The cover 3 of the flotation apparatus 1 may, as shown in the figures, be composed of a first cover part 29 and a second cover part 30 that is releasable attached to the first cover part 29. The first cover part 29 comprises a second aperture 31 that is covered by the second cover part 30, and the first aperture 8 is in the second cover part 30. The connection arrangement 10 is fastened to the second cover part 30. The second aperture 31 is circular, has a diameter that is larger than an outer diameter of a rotor 33 attached to the rotatable shaft 7 and a sealing is provided between the first cover part 29 and the second cover part 30.

The agitating means 6 of the flotation apparatus 1 may comprise a motor means 32 for rotating the rotatable shaft 7.

The invention relates also to a system for flotation, comprising a flotation apparatus 1 according to embodiment describe herein.

The invention relates also to a connection arrangement 10 for use in a method according to any embodiment described or in a flotation apparatus 1 according to any embodiment described. The connection arrangement comprises a connection piece 11 having at a first end a first opening 12 for the rotatable shaft 7 and having at a second end a second opening 13 for the rotatable shaft 7. The connection piece 11 comprises at least two connection piece parts 15 releasable connected to each other. Division planes 16 between said least two connection piece parts 15 extends between the first opening 12 and the second opening 13. The connection piece 11 comprises a first flange 17 at the first end for releasable fastening the connection piece 11 to the bearing housing 9, and a second flange 19 at the second end housing for releasable fastening the connection piece 11 to a bellow arrangement 18.

The invention relates also to the use of the method according to any embodiment described herein and to the use of the flotation apparatus according to any embodiment described herein in a flotation process of a slurry having a density that is between 1100 and 1600 kg/m$^3$, preferably between 1200 and 1400 kg/m$^3$.

The invention relates also to the use of the method according to any embodiment described herein and to the use of the flotation apparatus according to any embodiment described herein for creating a pressure difference.

The invention relates also to the use of the method according to any embodiment described herein and to the use of the flotation apparatus according to any embodiment described herein for separation of minerals.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. A method for constructing a flotation apparatus, the method comprising:

providing a flotation vessel and a cover for closing an upwards open opening of the flotation vessel, wherein the cover and the vessel limiting a vessel space for receiving fluid, providing an agitating means having a rotatable shaft, arranging the rotatable shaft of the agitating means to extend through a first aperture in the cover, supporting the rotatable shaft at a bearing housing outside the vessel space, providing a connection arrangement that surrounds the rotatable shaft between the bearing housing and the cover, attaching the connection arrangement to the bearing housing and to the cover so that the connection arrangement hermetically sealing the rotatable shaft between the bearing housing and the cover, providing a connection arrangement comprising a connection piece surrounding the rotatable shaft between the bearing housing and the cover, the connection piece that is provided comprising at an end facing the bearing housing a first opening for the rotatable shaft, the connection piece that is provided comprising at an end facing the vessel space of the flotation vessel a second opening for the rotatable shaft, the connection piece that is provided comprising at least two connection piece parts releasable connected to each other so that division planes between said least two connection piece parts extending between the first opening and the second opening, providing a gas feeding means comprising a gas feeding duct in the rotatable shaft of the agitating means, outside the vessel space a gas inlet for feeding gas into the gas feeding duct, and inside the vessel space a gas outlet for feeding gas from the gas feeding duct into the vessel space, connecting the gas feeding means in fluid connection with the vessel space, and arranging the bearing housing between the gas inlet and the cover.

2. The method according to claim 1, wherein the connection piece that is provided comprising a hollow truncated cone surrounding the rotatable shaft between the bearing housing and the cover the connection piece, so that the hollow truncated cone tapers towards the bearing housing, so that the connection piece having at the end facing the bearing housing the first opening for the rotatable shaft, and so that the connection piece having at the end facing the vessel space of the flotation vessel the second opening for the rotatable shaft.

3. The method according to claim 1, wherein the connection piece that is provided comprising a first flange at the end facing the bearing housing, and releasable fastening the connection piece to the bearing housing by using the first flange.

4. The method according to claim 1, wherein the connection arrangement that is provided comprising a bellow arrangement surrounding the rotatable shaft between the bearing housing and the cover.

5. The method according to claim 4, further comprising:

arranging the bellow arrangement between the cover and the connection piece, and arranging the connection piece between the bearing housing and the bellow arrangement.

6. The method according to claim 5, further comprising:

attaching the bellow arrangement to the connection piece by means of a second flange, and attaching the bellow arrangement to the cover by means of a third flange.

7. The method according to claim 6, further comprising:

connecting the second flange being with the third flange by means of a travel limiter to limit the travel of the second flange with respect to the third flange.

8. The method according to claim 1, further comprising:

supporting the rotatable shaft additionally at an additional bearing housing so that the gas inlet is situated between the bearing housing and the additional bearing housing.

9. A flotation apparatus comprising:

a flotation vessel and a cover for closing an upwards open opening of the flotation vessel, wherein the cover and the flotation vessel limiting a vessel space for receiving fluid, and an agitating means having a rotatable axis extending through a first aperture in the cover, wherein the rotatable shaft being rotatable supported at a bearing housing outside the vessel space, and further comprising:

a connection arrangement surrounding the rotatable shaft between the bearing housing and the cover, wherein the connection arrangement being attached to the bearing housing and to the cover so that the connection arrangement hermetically sealing the rotatable shaft, the connection arrangement comprising a connection piece surrounding the rotatable shaft between the bearing housing and the cover, the connection piece having at the end facing the bearing housing a first opening for the rotatable shaft, the connection piece having at the end facing the vessel space of the flotation vessel a second opening for the rotatable shaft, the connection piece comprising at least two connection piece parts releasable connected to each other, division planes between said least two connection piece parts extending between the first opening and the second opening, the apparatus comprising gas feeding means for feeding gas into the vessel space, the gas feeding means comprising a gas feeding duct in the rotatable shaft of the agitating means, outside the vessel space a gas inlet for feeding gas into the gas feeding duct, and inside the vessel space a gas outlet for feeding gas from the gas feeding duct into the vessel space, and the bearing housing being arranged between the gas inlet and the cover.

10. The flotation apparatus according to claim 9, wherein the connection piece comprising a hollow truncated cone, the connection piece tapering towards the bearing housing, the connection piece having at the end facing the bearing housing the first opening for the rotatable shaft, and the connection piece having at the end facing the vessel space of the flotation vessel the second opening for the rotatable shaft.

11. The flotation apparatus according to claim 9, wherein the connection piece comprising a first flange at the end facing the bearing housing for releasable fastening the connection piece to the bearing housing.

12. The flotation apparatus according to claim 9, wherein the connection arrangement comprising a bellow arrangement surrounding the rotatable shaft between the bearing housing and the cover.

13. The flotation apparatus according to claim 12, wherein the bellow arrangement being arranged between the cover and the connection piece, and the connection piece being arranged between the bearing housing and the bellow arrangement.

14. The flotation apparatus according to claim 13, wherein the bellow arrangement being attached to the connection piece by means of a second flange, and the bellow arrangement being attached to the cover by means of a third flange.

15. A connection arrangement for use in a method according to claim 1, comprising:

a connection piece, having at a first end a first opening for the rotatable shaft and having at a second end a second opening for the rotatable shaft, the connection piece comprising at least two connection piece parts releasable connected to each other, division planes between said least two connection piece parts extending between the first opening and the second opening, the connection piece comprising a first flange at the first end for releasable fastening the connection piece to the bearing housing, and the connection piece comprising a second flange at the second end housing for releasable fastening the connection piece to a bellow arrangement.

* * * * *